United States Patent [19]

Mailliet et al.

[11] Patent Number: 4,471,664

[45] Date of Patent: Sep. 18, 1984

[54] SUPPORT FOR A BLAST FURNACE PROBE

[75] Inventors: Pierre Mailliet, Howald; Victor Kremer, Luxembourg, both of Luxembourg

[73] Assignee: Paul Wurth S.A., Luxembourg, Luxembourg

[21] Appl. No.: 340,186

[22] Filed: Jan. 18, 1982

[30] Foreign Application Priority Data

Jan. 23, 1981 [LU] Luxembourg ..... 83086

[51] Int. Cl.[3] ..... G01N 1/22

[52] U.S. Cl. ..... 73/863.11; 73/863.85

[58] Field of Search ..... 73/863.85, 863.11

[56] References Cited

U.S. PATENT DOCUMENTS

| | | | |
|---|---|---|---|
| 3,130,584 | 4/1964 | Kennedy | 73/863.85 X |
| 3,643,508 | 2/1972 | Schneider | 73/863.85 X |
| 3,888,123 | 6/1975 | Kuntziger et al. | 73/863.85 X |
| 4,054,060 | 10/1977 | Ueno et al. | 73/863.85 |
| 4,283,947 | 8/1981 | George et al. | 73/863.11 |

*Primary Examiner*—S. Clement Swisher
*Assistant Examiner*—John E. Chapman, Jr.
*Attorney, Agent, or Firm*—Fishman & Dionne

[57] ABSTRACT

A horizontally movable sampling probe, for insertion into and retraction from a blast furnace, is supported in an aperture in the furnace wall. The support mechanism for the probe includes a fluid cooled guide block attached to the furnace shell and having a support portion extending toward the furnace interior at least part way through the refractory furnace wall lining.

8 Claims, 2 Drawing Figures

SUPPORT FOR A BLAST FURNACE PROBE

BACKGROUND OF THE INVENTION (1) Field of the Invention

The present invention relates to the taking of measurements in an operating furnace and particularly to the sampling of gases and/or the measuring of temperature at points along a radius of a blast furnace. More specifically, this invention is directed to furnace condition sampling probes and especially to supports for such probes which facilitate the use thereof and effectively extend the length thereof. Accordingly, the general objects of the present invention are to provide novel and improved methods and apparatus of such character.

(2) Description of the Prior Art

In order for a blast furnace, particularly a modern furnace which operates with a comparatively high pressure, to be operated so as to obtain the optimum results, it is essential to monitor conditions within the furnace. The conditions which are desirably monitored include the chemical composition of the gases produced and the temperature profile across the furnace charge. These conditions are sensed through the use of probes which may be inserted into the furnace, both above and into the charge, to collect gas samples and take temperature measurements. An example of a furnace probe may be seen by reference to U.S. Pat. No. 3,888,123.

In the case of a blast furnace, the probes are introduced horizontally via apertures provided in the lateral wall of the furnace. The wall of a blast furnace will consist of an outer metal shell or armouring and an inner lining of refractory material. As may be seen from U.S. Pat. No. 3,888,123, it has been prior practice to provide a support for a blast furnace probe on the outside of the shell. In order to obtain information which is as complete and accurate as possible the probe must be extended into the furnace to the region of the central axis thereof. Accordingly, a typical furnace probe may have a length of as much as 8 meters and, with a very large capacity furnace, the probe length could be even greater. This length, coupled with the fact that a furnace probe must of necessity be of comparatively heavy construction in order to withstand the harsh operating environment to which it is exposed, makes it difficult to provide adequate support.

As noted above, the practice in the prior art has been to support a furnace probe solely from a flange affixed to the exterior of the furnace shell. Accordingly, as the probe is extended into the furnace, it will deform under the effects of its own weight and the probe may also be caused to further deform or be deflected from the horizontal as a result of contact with the furnace charge material and particularly descending charge material. All of the stresses to which the probe is exposed will be concentrated at the point where the probe is supported and the magnitude of these concentrated stresses will be a function of the unsupported length of the probe in the furnace. The concentrated stresses at the support point will, of course, increase the friction between the probe and support and thus impede the movement of the probe. Accordingly, significant force is required to extend and retract the probe and the friction causes wear on the probe and the support.

SUMMARY OF THE INVENTION

The present invention overcomes the above-discussed and other deficiencies and disadvantages of the prior art and, in so doing, provides a novel and improved furnace probe support. Apparatus in accordance with the invention includes a probe guide block which extends inwardly, at least partly through the furnace refractory lining, from a flange which is affixed to the furnace shell. The guide block is provided, at its outwardly disposed end, with a hole through which the probe passes. The guide block is further provided, at its inwardly disposed end, with a support platform which terminates at a point which is displaced inwardly from the furnace wall by a distance which is greater than one-half ($\frac{1}{2}$) the thickness of the lining. This support platform is preferrably provided with a guide groove which is coaxial with the above-mentioned through-hole.

In accordance with a preferred embodiment, the inwardly disposed platform portion of the guide block is provided with a hard refractory steel facing on which the probe slides. The material from which this facing is fabricated is selected for its antiabrasive and heat resistant characteristics.

A support mechanism in accordance with the present invention contacts, and thus supports, a furnace probe at a position disposed further inwardly toward the furnace axis than has been characterized in the prior art. The movement of the probe support point inwardly reduces the unsupported length of the probe. In actual practice, the probe support point may be moved inwardly by a distances of about 80–100 cm. This is a significant improvement since the degree of deflection of the unsupported end of the probe is porportional to the cube of the unsupported length. Thus, by way of example, if the unsupported length of the probe is reduced by one (1) meter, for example from 5 to 4 meters, the sag resulting from the intrinsic weight of the probe will be reduced by 40% of the deflection of the end of an unsupported probe of 5 meters length.

Also in accordance with a preferred embodiment of the present invention, the guide block of the probe support mechanism is fluidically cooled.

A further feature of a preferred embodiment of the present invention is the provision for the use of pressurized gas to prevent the collection of particulate matter on those surfaces of the probe support mechanism which make actual contact with the exterior of the probe.

BRIEF DESCRIPTION OF THE DRAWING

The present invention may be better understood and its numerous objects and advantages will become apparent to those skilled in the art by reference to the accompanying drawing wherein like reference numerals refer to like elements in both figures and in which.

DESCRIPTION OF THE PREFERRED EMBODIMENT

Figure 1:
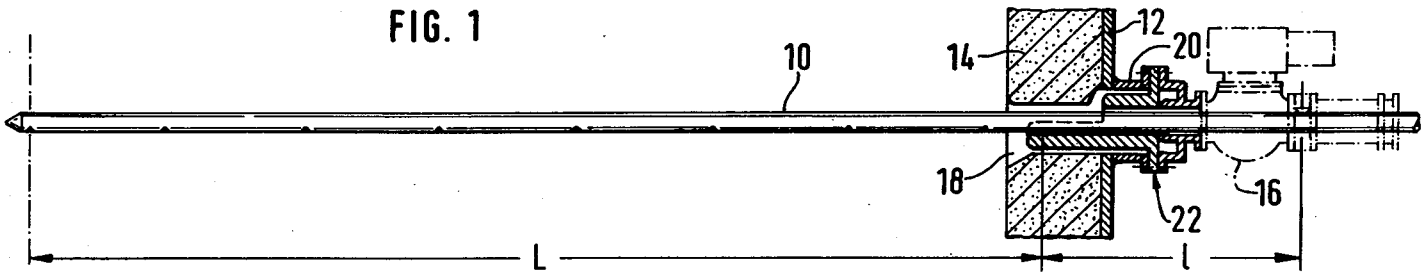
FIG. 1 is a schematic side elevation view, partly in section, of a probe support in accordance with the present invention.
Figure 2:
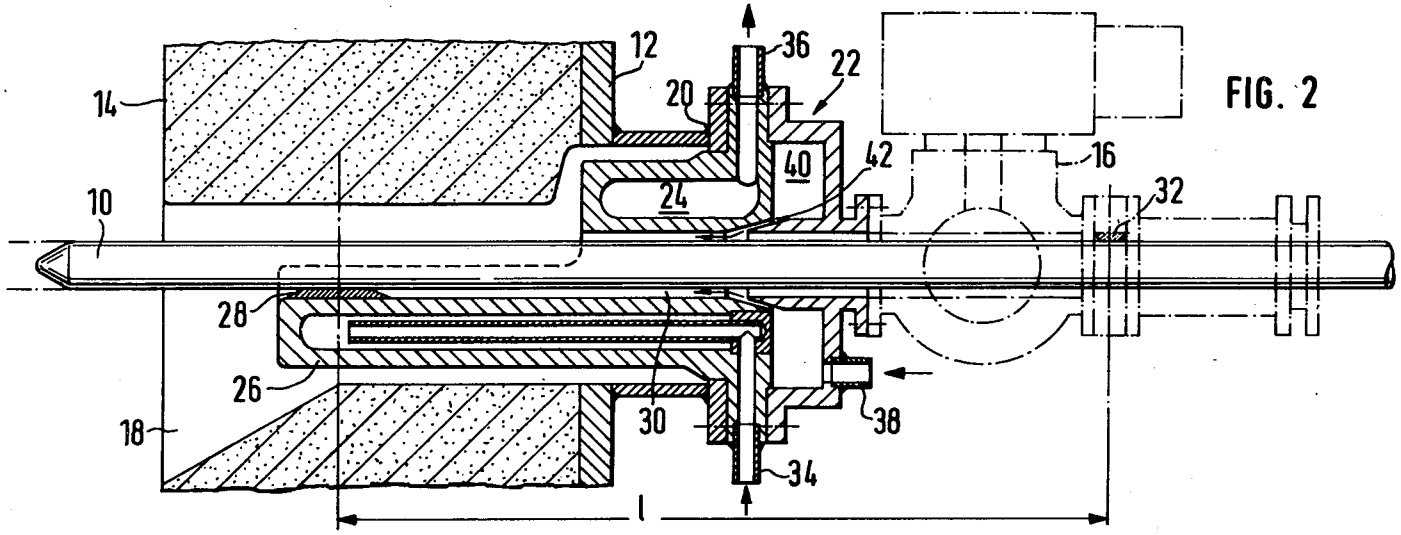
FIG. 2 is an enlarged side elevation view, also partly in section, of the probe support of FIG. 1.

With reference to the drawing, considering simultaneously FIGS. 1 and 2, a probe for sampling gas at a plurality of spaced locations within a blast furnace is indicated at 10. Probe 10 may, for example, be introduced into the material with which a furnace has been charged, typically in the horizontal direction, by insertion through an aperture in the furnace wall. In the case of a blast furnace, as represented in the drawing, the furnace wall comprises an outer shell or armour 12, typically comprised of steel, and an inner refractory lining 14. The entrance aperture for the probe is indicated at 18 and, of course, will extend through shell 12 and lining 14. The shell 12 will be provided with an integral flange 20, which extends outwardly as shown and which is typically of cylindrical shape. The flange 20 will typically have an annular plate affixed at its outermost end whereby a probe support, indicated generally at 22, may be attached to the flange. A valve, which has been indicated schematically and in phantom at 16, will be coupled to the probe support 22 and positioned outwardly with respect thereto. Valve 16 will be employed to close the aperture 18 in the furnace wall after the probe has been fully retracted.

The probe support 22 comprises essentially an apertured guide block 24 which is attached, for example by the means of bolts, not shown, to the annular plate portion of the flange 20. The guide block 24 will extend into flange 20 to a position generally in alignment with the furnace shell 12. A support platform or rest 26 extends inwardly, at least for a distance which is equal to more than half of the thickness of the refractory lining 14, from guide block 24. As shown in FIG. 2, the guide block 24 and the support platform 26 are integral in the preferred embodiment.

The guide block 24 is provided with a hole 30 through which the probe 10 is inserted. The diameter of through-hole 30 will, of course, be slightly larger than the diameter of the probe to facilitate movement of the probe. The support platform 26 has a generally C-shaped guide groove which is coaxial with, and preferably has the same radius as, the through-hole 30. At least in the vicinity of its inwardly disposed end, the support platform 26 is provided with a facing 28 comprised of a refractory hard steel. The probe 10 will rest on facing 28 which will constitute the only point of support for the bottom of probe 10. Accordingly, the facing 28 will determine the length "L" of the unsupported portion of probe 10. At the exterior of the furnace, and disposed outwardly with respect to valve 16, a further insert 32 which engages the upper side of probe 10 will be provided. Thus, the distance 37 l" is determined by the spacing between inserts 28 and 32.

A support mechanism in accordance with the present invention permits the length "l" to be increased relative to the length "L" thus reducing the ratio L/l. This, in turn, enables the reactions occurring at the support points 28 and 32 to be considerably reduced.

Referring again to FIG. 2, the support 22 is provided with a coolant inlet 34 and an outlet 36. In order to provide for the circulation of a liquid coolant through the guide block 24 and the support platform 26, these two elements are of hollow construction and a conduit is provided which causes the discharge of the coolant adjacent the most inwardly disposed end of the support platform, the coolant then returning along the support platform and guide block and flowing outwardly through discharge 36.

In order to ensure against the accumulation of dust or dirt in through-hole 30 and the coaxial guide groove in platform 26, provision is made for the washing of these areas with a stream of pressurized gas. For this purpose, the support 22 is provided with a gas inlet orifice 38 which leads to an annular chamber 40. Compressed gas delivered to chamber 40 is discharged via a circular port 42 into through-hole 30 and will thus wash the hole 30 and the coaxial groove.

As will be recognized by those skilled in the art, the probe support of the present invention may be employed with sampling probes which are inserted into the furnace charge and with probes which are inserted above the charge.

While a preferred embodiment has been shown and described, various modifications and substitutions may be made thereto without departing from the spirit and scope of the invention. Accordingly, it will be understood that the present invention has been described by way of illustration and not limitation.

What is claimed is:

1. A support mechanism for a measuring probe, the probe being intended to be introduced in a horizontal direction into a furnace via an aperture in the furnace wall, the furnace wall being defined by an outer metal casing and inner lining of refractory material, the probe support comprising:

flange means mounted on the furnace casing at the exterior of the furnace, said flange means being coaxial with the aperture in the furnace wall;

guide block means supported from said flange means, said guide block means at least partly extending into said flange means and being provided with a through hole sized to permit passage of the probe;

support platform means, said support platform means extending from said guide block means to an end in the furnace wall aperture a distance which is at least half the thickness of the refractory lining, said support platform means having a probe guide groove which is coaxial with said guide block means through-hole;

support means in said guide groove adjacent said end of said support platform means for supporting the furnace probe from below at a point adjacent said end of said support platform means; and means for establishing a flow of pressurized gas through said guide block means through hole and over a portion of said support platform means to thereby prevent the accumulation of particulate matter on the surfaces thereof.

2. The apparatus of claim 1 further comprising:

means for circulating a coolant through said guide block means and said support platform means.

3. The apparatus of claim 2 wherein said guide groove of said support platform means is generally C-shaped and has a radius equal to the radius of the guide block means through-hole.

4. The apparatus of claims 2 or 3 further comprising:

insert means positioned to the exterior of the furnace for contacting the upper side of the probe to reduce reactions occuring in the probe.

5. The apparatus of claim 1 wherein said guide groove adjacent said end of said support platform means is provided with a facing of a refractory material to constitute the sole support for the bottom of the probe within the support.

6. The apparatus of claim 1 further comprising:

means for circulating a coolant through said guide block means and said support platform means.

7. The apparatus of claim 1 wherein said guide groove of said support platform means is generally C-shaped and has a radius equal to the radius of the guide block means through-hole.

8. The apparatus of claims 1, 5, 6 or 7 further comprising:

insert means positioned to the exterior of the furnace for contacting the upper side of the probe to reduce reactions occuring in the probe.

* * * * *